United States Patent [19]

Morgan et al.

[11] 4,024,362

[45] May 17, 1977

[54] SWITCH ACTUATOR ASSEMBLY FOR MULTIPLE INDEPENDENTLY CONTROLLED LEAF SPRING CONTACT ARRAYS

[75] Inventors: A. Henry Morgan, Westport, Conn.; Lewis J. Seiden, Tappan, N.Y.

[73] Assignee: T-Bar Incorporated, Wilton, Conn.

[22] Filed: Sept. 19, 1975

[21] Appl. No.: 614,789

[52] U.S. Cl. ..... 200/1 TK; 200/296; 200/339

[51] Int. Cl.[2] ..... H01H 9/00; H01H 3/32

[58] Field of Search ..... 200/1 R, 1 A, 1 TK, 200/6 R, 6 B, 6 BA, 6 BB, 6 C, 164 R, 246, 283, 335, 339, 288, 296

[56] References Cited

UNITED STATES PATENTS

| | | | |
|---|---|---|---|
| 2,604,553 | 7/1952 | Babcock | 200/1 TK |
| 2,611,835 | 9/1952 | Mossman, Sr. | 200/1 TK |
| 2,623,958 | 12/1952 | Loge | 200/1 TK |
| 2,630,499 | 3/1953 | Weld | 200/1 TK |
| 2,854,533 | 9/1958 | De Lancey | 200/6 BB |

FOREIGN PATENTS OR APPLICATIONS

| | | | |
|---|---|---|---|
| 1,144,637 | 4/1957 | France | 200/1 TK |

*Primary Examiner*—James R. Scott
*Attorney, Agent, or Firm*—Dorfman, Herrell and Skillman

[57] ABSTRACT

Multiple sets of parallel flat resilient conductive switch blades arranged side-by-side support opposed contact pairs and in turn are cantilever supported by engagement of each blade at a position remote from its contact area in an insulating wall of a relatively rigid support frame. One of the blades of each pair is moved by actuator means engaging the end remote from the point of support. The actuator means rotatably supported on the frame provides a slot which closely engages the ends of at least some of the blades essentially in the plane of the slot so that actuator rotation opens and closes supported contacts.

13 Claims, 4 Drawing Figures

SWITCH ACTUATOR ASSEMBLY FOR MULTIPLE INDEPENDENTLY CONTROLLED LEAF SPRING CONTACT ARRAYS

The present invention relates to an improved actuator means for switches in parallel side-by-side arrangements. More particularly, the present invention relates to a simple actuator which lends itself to manual control and which may be designed to provide multiple actuator means of the same kind to actuate different groups in an array of side-by-side switches.

In the prior art, many techniques have been developed by the assignee of the present application for high density mechanical switch configurations of a type disclosed and claimed in U.S. Pat. No. 3,226,508 to A. H. Morgan et al. Such switches characteristically could be manufactured in separate modules or wafers containing many switches within a single wafer and capable of combination into stacks of wafers having a single actuator, the actuator being either manual or electromechanical, or of any other type.

The individual wafers or modules of such switches is characterized in that they comprise multiple sets of at least opposed pairs of parallel flat resilient conductive switch blades arranged side-by-side with the respective corresponding blades supported in generally common planes, generally parallel to one another, by rigid engagement of each blade at a position remote from its contact area by an insulating wall of a relatively rigid support frame, frequently in the form of a hollow rectangular housing. One of the blades of each pair is moved by actuator means engaging its remote end from the point of support on the frame and more proximate to its contacts.

Typically in the prior art, three parallel blades would be provided offering two pairs of contacts, with the middle blade being movable from a position in which one pair of contacts is engaged and the other pair disengaged, to a position in which the other pair is engaged and the first disengaged. This might possibly involve moving through a middle position in which neither pair of contacts is engaged. The actuation in the prior art, as shown in U.S. Pat. No. 3,226,508, was through a central bar and the structure was made symmetrical with switches projecting toward the bar and into slots in the bar from opposite supported ends of the wafer housing. It is by stacking the wafers and connecting them mechanically together while connecting the bars mechanically together, that actuation of the switches is made possible, by a common lateral motion transverse to the switches actuating all of the switches at the same time. While it is possible to have different kinds of switches within a single wafer, or within different wafers in a stack, all of the switches have to be actuated in the same manner. It is also possible to achieve many different effects by the wiring of the switches and it is possible to use all of these switches, or omit some of them, in a given installation.

More recently, the switch construction for switches used in such an arrangement was improved in connection with U.S. Pat. No. 3,689,856, dated Sept. 5, 1972, issued to James B. Lambert et al, and assigned to the assignee of the present application.

More specifically, the present invention relates to a switch array having a multiple set of at least opposed pairs of contact on opposed pairs of parallel flat resilient conductive switch blades arranged side-by-side with the respective corresponding blades supported in generally common planes generally parallel to one another by rigid mechanical engagement of each blade at a position remote from its contact area by insulating means on a support frame. One of the blades of each pair is moved from its plane by actuator means engaging its end remote from the point of support on the frame and more proximate to the contact. The improvement of the present invention is the actuator means, including a rigid rotatable actuator member rotatably supported on the frame for oscillatory movement about a fixed axis on the frame. This rigid member provides a slot positionable to closely engage the ends of at least some of the blades in that plane. The actuator means requires means rotatably supporting it on the frame for oscillatory movement. When the actuator means is rotatably moved about its axis, it moves the engaged blades in the direction transverse to their original plane and their supported contacts toward or away from engagement with their opposed contacts.

Preferably, resilient means is provided between the frame and the actuator means to restore the actuator means to a predetermined position. Also, detent means is provided to retain the actuator means in at least one predetermined position into which it was moved against the restraining force of the resilient means. Preferably, too, a plurality of similar actuator means supported on the frame by common means permitting rotation about a common axis engage different blades in the same plane, and thereby define distinct groups of commonly actuated switches within the array.

For a better understanding of the present invention, reference is made to the accompanying drawings, in which.

Figure 1:
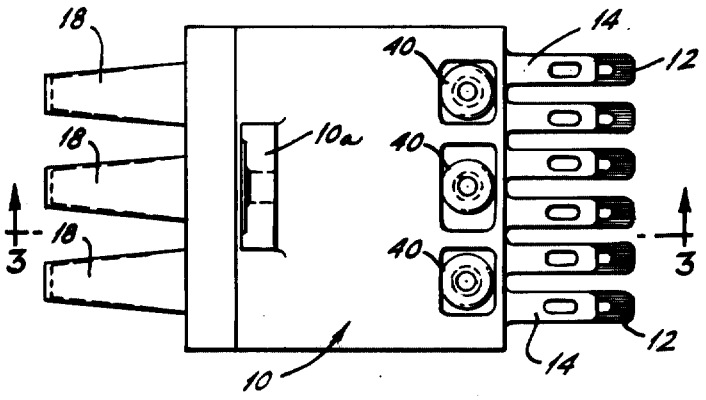
FIG. 1 is a plan view of the switch array embodying the improved actuators of the present invention in a housing wafer.
Figure 2:
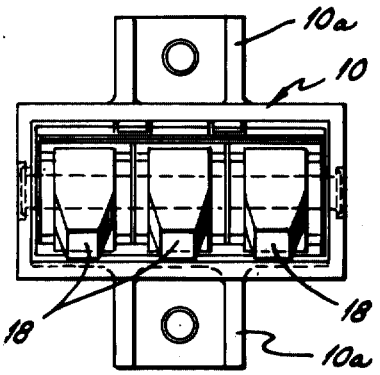
FIG. 2 is an end view from the actuator end of the structure shown in FIG. 1.
Figure 3:
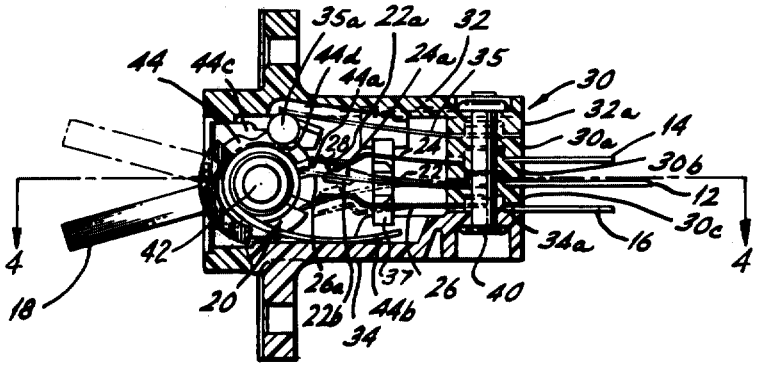
FIG. 3 is a sectional view taken along one 3—3 of FIG. 1 of the same structure.

Referring to the drawings, there is illustrated a preferred embodiment of high density switch members in a compact housing, or wafer, having actuators in accordance with the present invention. Referring to FIG. 1, the housing, or wafer, consists of a hollow box 10 of insulating materials. The housing includes internally the plurality of switch elements which are provided with external terminals 12, 14 and 16 as seen in FIG. 3 for each switch combination. At one end of the structure are a plurality of toggle elements 18, each of which constitutes a part of an improved actuator member, generally designated 20, in FIGS. 3 and 4. The housing may be provided with a pair of laterally extending mounting brackets **10*a*** for convenient mounting in some applications.

Figure 4:
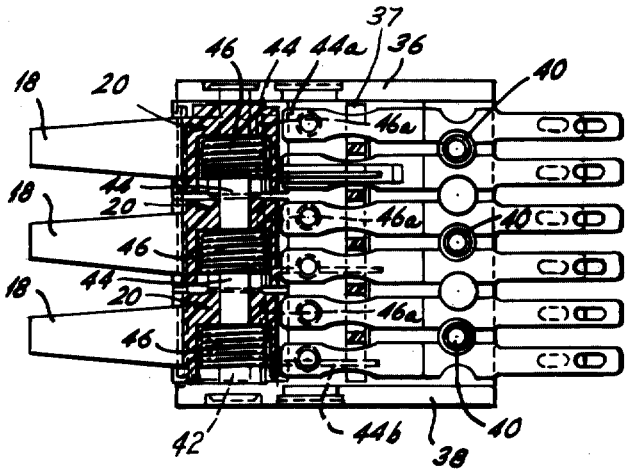
FIG. 4 is a sectional view taken along line 4—4 of FIG. 3.

The switch construction which is best seen in FIGS. 3 and 4 will be recognized to be similar to that shown in U.S. Pat. No. 3,226,508, previously referred to. The individual switch combination shown, as best seen in FIG. 3, is provided by three generally parallel switch blades 22, 24 and 26. The longer central blade 22 in the embodiment shown is provided with contacts **22*a* and 22*b*, which may be provided by a single cylindrical shouldered member 28, as illustrated. The contact surfaces may preferably be domed so as to make better rubbing contact with opposed contact regions 24a and 26a of blades 24 and 26, which blades are suitably bent and formed to provide the best contact geometry in given circumstances. If desired these blades may be slotted at their ends to form bifurcated contacts as taught in U.S. Pat. No. 3,689,856. The cylindrical contact body 28, which provides contacts 22a and 22b, is preferably made of a good contact material, of one of the types well known in the art. The switch blades themselves are preferably made of berillium-copper or other alloy which, not only supplies high conductivity, but greater resiliency. The switch blades are all supported relative to one another and to other switch elements and other structures of the switch, including actuator means 20, by a support frame. In this case, support is provided by insulating wall 30 of the housing 10. The housing is preferably made so that it may be preassembled between top and bottom housing walls 32 and 34. Wall 34 may be channel shaped, if desired, to provide edge walls 36 and 38, as seen in FIG. 4. Alternatively, walls 32 and 34 may provide opposed grooves to receive sliding pieces to form the edge walls 36 and 38. There are many suitable wall and housing constructions the nature of which do not relate to the present invention. As seen in FIG. 3, portions of the top and bottom walls 32 and 34 are formed to provide part of the end wall by forming extensions 32a and 34a which provide similar end pieces, together with stacked pieces 30a, 30b and 30c. These end wall pieces are of such dimensions as to clamp the switch blades 26, 22 and 24, as well as a detent blade 35, between adjacent pieces and hold the switch blades in contact with their respective terminals 16, 12 and 14** to which they may also be soldered or welded.

As will be seen in FIG. 4, in this embodiment there are six sets of switches in side-by-side arrangment with corresponding blades of other switches arranged generally in corresponding planes with the switch blades 26, 22 and 24, respectively, which generally planar arrangements are essentially parallel to one another.

As the structure is assembled, an insulating spacer grid 37 also introduced to help maintain switch spacing and limit the amount of contact follow permitted blades 24 and 26, as well as to position detent blade 35 and hold all blades in proper relative lateral position. When the switch assembly is completed and the actuator means to be described have been put in place and appropriate switch blades engaged, the whole assembly is riveted together through aligned holes provided in each of the insulating pieces composing end wall 30 by a set of three similar rivets 40.

The actuator means 20, which is unique in the present application, centers around a cylindrical pivot pin 42 extending between edge walls 36 and 38 to provide an axis of rotation as well as supports for each of the actuator means 20. Each of the three actuator means shown in the present assembly is an insulating member 44 which may, for example, be molded, including a bore providing with a sliding fit over the pivot pin 42. Actuation of switches is achieved by means of similar slot 44a in each insulating member 44, and each actuator means engages the end remote from the supported end of corresponding ones of the switch blades of a selected plurality of switches. In this case, the end of center switch blade 22 is engaged, and each of the three actuator means slots 44a engages two switch blades in the embodiment shown. By rotation of the toggle, as shown in FIG. 3, the slot 44a is rotated about pivot 42 in an oscillatory manner which will enable movement at one extreme in which contact 22a engages contact 24a in good electrical contact to another extreme in which contact 22b engages contact 26a in good electrical contact after the formerly connected contacts have been broken. In some embodiments, an intermediate switch position may represent a position in which both sets of contacts are open.

Preferably, the actuator is biased into a particular position, such as the full line position shown in FIG. 3, by use of a spring 46 or other suitable resilient means connected between the actuator means and the frame or housing. In this particular embodiment, the spring 46 is a coil spring which is provided with one tine end 46a parallel to the axis which may be slid into a retaining opening in the actuator means 44 as the spring is moved into a counter-sunk, or enlarged, axial opening at one side of the actuator. The other end of the spring 44b, as best seen in FIG. 3, is extended and arranged to bear against the wall 34 of the housing. As the actuator toggle 18 is moved from the position shown in full lines to the position shown in phantom in FIG. 3, spring 46 is tightened and will tend to urge a return to the full line position. However, as seen in FIG. 3, each actuator means is provided with a groove 44c into which a ball detent 35a is urged by the spring force exerted upon it by the detent blade 35 as the actuator is moved into the phantom position. The radial force thus applied holds the ball detent 35a in the groove 44c against the restoring force of spring 46 until toggle handle 18 is moved back toward its original position moving actuator means in such a direction as to urge the ball detent 35a out of the groove 44c. For the sake of stability further groove 44d may be provided to assure a stable position for the detent 35a to hold contacts 22a and 24a squarely in closed contact position, as shown.

Although the embodiment illustrated shows six sets of switches, it would be obvious to employ but a single actuator means or any number of actuator means to engage different numbers of switches in combinations. Furthermore, the use of means other than a toggle type lever, as shown, such as a knurled thumb screw edge, or the like, may be employed with the actuator means, as desired.

Many other modifications of the invention, as disclosed, will occur to those skilled in the art. All such modifications within the scope and spirit of the appended claims are intended to be within the scope and spirit of the present invention.

I claim:

1. In a switch array having multiple sets of at least opposed pairs of contacts, opposed pairs of parallel flat resilient conductive switch blades arranged side-by-side with the respective corresponding blades cantilever supported in generally common planes generally parallel to one another by rigid mechanical engagement of each blade at one end by an insulating portion of a support frame, the contacts being supported on said blades opposed to one another adjacent to the unsupported end of the blade, one of the blades of each pair being moved from its plane by actuator means engaging that blade at its unsupported end proximate to its contact, an improved actuator means comprising a rigid rotatable member providing a generally planar slot open at one edge to receive and closely engage the ends of at least two corresponding blades essentially in the plane of the slot in some position of the slot, said rigid rotatable member being rotatably supported on the frame for oscillatory movement relative to the frame about a fixed axis within the plane of the slot or parallel to the slot and means on said rigid member to permit said rigid member to be rotatably moved about its axis to move the slot-engaged end of engaged blades in a direction generally transverse to their plane and their supported contacts toward or away from engagement with their opposed contacts, and means acting between the frame and the rigid rotatable means to releasably hold the rigid rotatable member against rotation when its actuated contacts are engaged.

2. The improved switch array of claim 1 in which resilient means between the frame and the rigid rotatable actuator means acts to restore the actuator means to a predetermined position.

3. The improved switch array of claim 2 in which the releasable holding means is detent means which retains the actuator means against the force of the resilient means in at least one predetermined contact engaging position into which it is moved.

4. The switch array of claim 3 in which the detent is provided by resilient flat detent blade arranged generally parallel to the planes of the switch blades and supported by the frame in a position proximate to the position of switch blade support and providing at its remote end a detent element which is urged into a surface of the rotatable actuator means by the inherent resiliency of the detent blade and which engages a cooperating surface on the actuator means when moved to a predetermined position to latch the actuator in said predetermined position.

5. The switch array of claim 4 in which the detent surface of the actuator means has smooth contours permitting release of the detent element of the detent blade by additionally manual force to rotate the actuator means so that the smooth contours urged the detent element outward to release the actuator means.

6. The improved switch array of claim 1 in which a plurality of similar actuator means supported in the frame and rotatable about a common axis engage different blades in the same plane and thereby define distinct groups of commonly actuated switches within the array.

7. The improved switch array of claim 6 in which each actuator is provided with separate resilient means between the frame and the respective actuator means to restore the respective actuator means to predetermined positions.

8. The improved switch array of claim 3 in which at least one of the actuator means is provided with detent means to retain that at least one actuator means against the restoring force of the resilient means in at least one predetermined position into which it is moved.

9. The improved switch array of claim 8 in which the individual rigid rotatable member of each actuator means is of generally cylindrical form supported in side-by-side arrangement on a common cylindrical pin fixed to the frame and each is provided with actuator finger pieces on the diametrically opposed side of the cylinder from the blade engaging slot which extends generally inward from an element on the periphery of the cylinder.

10. The improved switch array of claim 9 in which the finger pieces are levers generally radially extending from the cylindrical actuator means.

11. The switch array of claim 9 in which the frame provides a generally closed housing in the form of a hollow rectangular solid with the actuator means of a size and orientation to extend across and close one end of the housing.

12. The switch array of claim 1 in which blade extensions through to the other side of the rigid frame support essentially electrically continue the blades to provide a plug configuration for quick engagement and disengagement of a mating circuit connection means.

13. The switch array of claim 1 in which the support frame includes an enclosing housing surrounding and protecting the switch blades and contacts.

* * * * *